US005420006A

United States Patent [19]

Jury

[11] Patent Number: 5,420,006

[45] Date of Patent: May 30, 1995

[54] PROCESS FOR PREPARING A MATTE, PHOTOSENSITIVE SILVER HALIDE RECORDING MATERIAL

[75] Inventor: Erhard Jury, Kelkheim-Fischbach, Germany

[73] Assignee: E. I. Du Pont de Nemours and Company, Wilmington, Del.

[21] Appl. No.: 170,967

[22] Filed: Dec. 21, 1993

[30] Foreign Application Priority Data

Dec. 24, 1992 [DE] Germany ..... 42 44 065.3

[51] Int. Cl.[6] ..... G03C 1/015; G03C 7/392; G03C 11/06

[52] U.S. Cl. ..... 430/569; 430/567; 430/523; 430/527; 430/950; 430/961

[58] Field of Search ..... 430/569, 950, 567, 523, 430/961, 527

[56] References Cited

U.S. PATENT DOCUMENTS 3,854,952 12/1974 Kenney ..... 430/569
4,419,442 12/1983 Falxa et al. ..... 430/567
4,980,273 12/1990 Fautz ..... 430/496

FOREIGN PATENT DOCUMENTS 3700551 1/1987 Germany .
WO91/06035 5/1991 WIPO .
WO91/06036 5/1991 WIPO .

OTHER PUBLICATIONS

Research Disclosure, Chapter I, pp. 993–995, Dec. 1989, No. 308119.

*Primary Examiner*—Charles L. Bowers, Jr.
*Assistant Examiner*—Mark F. Huff

[57] ABSTRACT

Photosensitive matting agents for photosensitive recording materials that are known can be prepared only at considerable expense. A much simplified process involves preparing a photosensitive matte material from photoinsensitive matting agent particles by incorporating the particles into the starting solutions for the silver halide precipitation. The invention is particularly useful in reprography and in medical diagnostics.

20 Claims, No Drawings

PROCESS FOR PREPARING A MATTE, PHOTOSENSITIVE SILVER HALIDE RECORDING MATERIAL

BACKGROUND OF THE INVENTION

1. Field of the Invention

The invention involves a process for preparing a matte, photosensitive silver halide recording material in which the particles of the matting agent are photosensitive and are darkened when an image is recorded.

2. Description of Related Art

Photosensitive silver halide recording materials frequently have a matte surface. The surface roughness diminishes the tendency to accumulate an electrostatic charge and the susceptibility to scratches by coarse dust particles. The roughness also facilitates removing air between the original and the recording material in reprographic copying.

The most important method for producing surface roughness practically is to add finely divided solid materials to coating solutions.

If the layer containing the particles of the solid material is coated simultaneously with the silver halide emulsion layer on the same side of the support and dried, the undesirable "starry night" effect can occur. In this case, exposed and processed image areas show pinpoint light spots. These are caused by particularly large particles or agglomerates of the usually polydispersed, finely divided solid material, which, on drying, displace the silver halide emulsion laterally.

DE 37 00 551-C2 describes a photosensitive silver halide recording material containing a photosensitive matting agent of 1 to 30 μm particles. These darken after exposure and processing and therefore, do not cause light spots if the particles displace the silver halide emulsion. The particles of this matting agent contain a chemically and optionally, spectrally, sensitized silver halide, a binder, and a finely divided solid with a particle size clearly below that of the matting agent and with no permanent inherent color.

The preparation of photosensitive matting agents described in the current art requires several operating steps. In the simplest instance, a portion of the silver halide emulsion intended for the photosensitive layer of the recording material is mixed with a hardening agent and the finely divided solid, and is spray-dried. The resulting powder is screened, if necessary, and added to one of the coating solutions in preparing the photosensitive material. Obviously, these process steps, which are somewhat unusual for the photographic products industry, must be conducted under darkroom conditions.

SUMMARY OF THE INVENTION

The invention involves the problem of providing a significantly simplified process, compared to the current state of the art, for preparing matte, photosensitive silver halide recording materials.

This problem is solved by a process for preparing a matte, photosensitive silver halide recording material containing a photosensitive matting agent characterized by the addition of particles of a water insoluble solid to at least one of the starting solutions for precipitating silver halide.

DESCRIPTION OF THE PREFERRED EMBODIMENT

The silver halide can be precipitated by known methods, such as are described, for example, in Research Disclosure 308 119 (December 1989) Section I. In particular, the single jet or double jet process can be used, optionally with silver ion concentration control.

"Starting solutions" are those added for precipitation in the precipitation vessel and also a solution provided optionally before the start of precipitation in the precipitation vessel. The starting solutions contain either a water-soluble silver salt, usually silver nitrate, or one or more water-soluble halides. A hydrophilic colloid, usually gelatin, required to stabilize the silver halide crystal dispersion can be added to one or more of the starting solutions.

The particle size of the water-insoluble solid is approximately equal to that of the photosensitive matting agent in the finished recording material. In the invention's process, the photosensitive matting agent particles are produced during precipitation of silver halide for the photosensitive silver halide emulsion layers of the recording material and remain in the emulsions. The particles of the solid and of the photosensitive matting agent are therefore preferably at least as large as the total thickness, after drying, of all layers coated on the support side bearing the photosensitive layer. The useful range is between 1 and 30 μm.

An especially preferred range for the particle size of the water-insoluble solid is between 3 and 15 μm.

"Particle size" means the numerical average of the diameters of spheres equivalent in volume to the particles.

A solid with a monodisperse particle size distribution is particularly preferred. "Monodisperse" means the ratio of the particle diameter at the 75% point to that at the 25% point on the cumulative frequency curve is at most 1.5.

It can be assumed that the solid particles, as a result of their presence during precipitation, bind silver halide microcrystals to their surfaces and in available pores. Thus they acquire the characteristic of a photosensitive matting agent.

Preferred particles are porous and with a rough surface. Surface roughness can be produced, for example, by etching. Porous solid particles are commercially available, for example, for chromatography or as adsorbents, which have a large inner surface.

A preferred water-insoluble solid is silicon dioxide. This is available in a porous form with various dimensions, for example, as dried, precipitated silicic acids.

The solid particles are added to the starting solutions before the beginning of precipitation. It is advantageous to expose the suspensions, before use, to an ultrasonic field. This disintegrates existing agglomerates and prevents the formation of others. The addition of a surfactant, particularly non-ionic or anionic, is especially preferred. Examples are nonyl or octylphenol ethoxylate with 10 to 20 ethylene oxide units per molecule, sodium lauryl sulfate, and the sulfonates of bis-ethoxyalkyl phenols.

After precipitation and optionally, physical ripening, soluble salts are removed from the invention's emulsions in the usual manner, for example, by flocculation or reverse osmosis. The emulsions are then chemically sensitized and optionally, also optically sensitized, in the usual manner; more gelatin can be added at any time.

Then the usual stabilizers, coating aids, and optionally, other additives are added to impart specific properties to the recording material. Surprisingly, the presence of the solid particles does not interfere with the process steps required for preparing ready-to-coat emulsion.

The invention is used for preparing photosensitive recording materials with silver halides, particularly for use in reprography and medical diagnostics.

EXAMPLE 1.5 g of a porous silicon dioxide powder with a 7 μm particle size and a 0.4 μm average pore width were stirred into a solution of 1784 g silver nitrate in 3150 g water. The suspension was exposed to an ultrasonic field for 5 minutes and used in a pAg-controlled double-jet feed method for preparing silver chlorobromide emulsion (30 mole percent bromide) with cubic microcrystals having a 0.35 μm edge length. The emulsion contained 16 g gelatin per mole of silver halide. Soluble salts were removed by the flocculation method. The emulsion curds were redispersed with another 45 g gelatin per mole of silver halide and subjected to chemical ripening with thiosulfate and gold salt for optimum sensitivity. Finally, the emulsion was made ready for coating by the addition of the usual stabilizers, coating aids, and an optical sensitizer for the green spectral region.

The emulsion together with an aqueous gelatin overcoating solution was coated on a polyethylene terephthalate support provided with an adhesive layer. The thickness of the dried layers was 4 μm for the emulsion layer and 1 μm for the overcoating. The resulting recording material was labeled Sample A.

Sample B was prepared in the same manner, except that, instead of porous silicon dioxide powder, a powder of an anhydrous precipitated silicic acid with a 4.6 μm particle size was added to the silver nitrate solution before precipitation.

For comparison, Sample C was prepared like Sample A, except that a solid material was not added to the starting solutions before precipitation. Instead, the silicon dioxide powder used for Sample A was dispersed in the overcoating solution as a matting agent.

The recording materials were exposed overall with illumination corresponding to the saturation region of the characteristic curve and processed in a roller developing machine. Although Sample C showed a definite "starry night" effect, Samples A and B were free from this defect. The optical density measured with a 3 mm diameter diaphragm was 0.6 greater for Samples A and B than for Sample C.

Examination of unprocessed materials with a light microscope showed in all three samples matte particles protruding from the overcoating. These were darkened in Samples A and B after exposure and development and appeared light in Sample C by transmitted light.

The gelatin containing layers of other samples of unprocessed materials were dissolved by a proteolytic enzyme. The solutions were let stand. The matting agent particles settled, were separated, washed, and prepared for examination with a scanning electron microscope. The surfaces of the particles isolated from Samples A and B were covered with cubic silver halide microcrystals.

What is claimed is:

1. A process for preparing a matte photosensitive silver halide recording material having a support bearing on a side at least one photosensitive layer, the material containing a photosensitive matting agent, characterized by the addition of particles of a water insoluble solid to at least one starting solution for precipitating silver halide during emulsion preparation wherein microcrystals of the silver halide bind to surfaces and/or in pores of the solid particles; the solid particles having a particle size between 1 and 30 μm and the size of the particles and of the photosensitive matting agent are approximately as large as the total thickness of all layers coated on the support side bearing the photosensitive layer.

2. The process according to claim 1, characterized in that the solid particles have a particle size between 3 and 15 μm.

3. The process according to claim 2, characterized in that the solid particles have a rough surface and/or a porous structure.

4. The process according to claim 1, characterized in that the solid particles are monodisperse.

5. The process according to claim 4, characterized in that the solid particles have a rough surface and/or a porous structure.

6. The process according to claim 1, characterized in that the solid particles consist of silicon dioxide.

7. The process according to claim 1, characterized in that a suspension of the solid particles in the starting solutions is exposed to an ultrasonic field before use in precipitation.

8. The process according to claim 7, characterized in that a surfactant is present in the suspension.

9. The process according to claim 1, characterized in that the silver halide emulsion is sensitized chemically or chemically and optically.

10. A process for preparing a matte, photosensitive silver halide recording material comprising at least one light sensitive silver halide emulsion layer and containing a photosensitive matting agent, the process comprising:

a) adding particles of a solid insoluble in water to at least one starting solution for precipitating silver halide, wherein microcrystals of the silver halide bind to surfaces and/or in pores of the solid particles, the solid particles having a particle size between 1 and 30 μm;

b) forming a light sensitive silver halide emulsion containing a light sensitive matte agent; and c) coating said emulsion on a support wherein the size of the particles and of the photosensitive matting agent are approximately as large as the total thickness of all layers coated on the support.

11. The process of claim 10, wherein the emulsion is not subjected to spray drying prior to coating.

12. The process of claim 10, wherein the emulsion is not spray dried forming light sensitive powder.

13. The process of claim 10, wherein the solid particles have a particle size between 3 and 15 μm.

14. The process of claim 13, wherein the solid particles have a rough surface and/or a porous structure.

15. The process of claim 10, wherein the solid particles are monodisperse.

16. The process of claim 15, wherein the solid particles have a rough surface and/or porous structure.

17. The process of claim 10, wherein the solid particles consist of silicon dioxide.

18. The process of claim 10, further comprising exposing a suspension of the solid particles in the starting solution to an ultrasonic field before precipitation.

19. The process of claim 18, wherein a surfactant is present in the suspension.

20. The process of claim 10, wherein the emulsion is chemically or chemically and optically sensitized.

* * * * *